US005817937A

United States Patent [19]

Beshoory et al.

[11] Patent Number: 5,817,937

[45] Date of Patent: Oct. 6, 1998

[54] COMBINATION DRILL MOTOR WITH MEASUREMENT-WHILE-DRILLING ELECTRONIC SENSOR ASSEMBLY

[75] Inventors: Edward Joseph Beshoory; William David Murray, both of Houston; Heino Rohde, Montgomery, all of Tex.

[73] Assignee: Bico Drilling Tools, Inc., Houston, Tex.

[21] Appl. No.: 824,148

[22] Filed: Mar. 25, 1997

[51] Int. Cl.[6] ..... E21B 4/02

[52] U.S. Cl. ..... 73/152.46

[58] Field of Search ..... 73/152.43, 152.46, 73/152.47, 152.48; 175/40, 50

[56] References Cited

U.S. PATENT DOCUMENTS

| | | | |
|---|---|---|---|
| 3,686,942 | 8/1972 | Chatard et al. | 73/152.48 |
| 3,822,589 | 7/1974 | Le Peuvedic et al. | 73/152.47 |
| 3,827,294 | 8/1974 | Anderson | 73/152.48 |
| 3,840,080 | 10/1974 | Berryman | 175/107 |
| 3,855,853 | 12/1974 | Claycomb | 73/152.48 |
| 4,492,276 | 1/1985 | Kamp | 175/61 |
| 4,608,861 | 9/1986 | Wachtler et al. | 73/152.48 |
| 4,679,638 | 7/1987 | Eppink | 175/107 |
| 4,811,597 | 3/1989 | Hebel | 73/151 |
| 5,160,925 | 11/1992 | Dailey et al. | 73/152.46 |
| 5,163,521 | 11/1992 | Pustanyk et al. | 175/40 |
| 5,235,285 | 8/1993 | Clark et al. | 324/342 |
| 5,251,708 | 10/1993 | Perry et al. | 73/152.46 |
| 5,325,714 | 7/1994 | Lende et al. | 73/153 |
| 5,456,106 | 10/1995 | Harvey et al. | 73/152.46 |
| 5,467,832 | 11/1995 | Orban et al. | 175/45 |

OTHER PUBLICATIONS

Adam T. Bourgoune Jr. et al., "Applied Drilling Engineering," SPE Textbook Series, vol. 2, 1991, pp. 402–410.

*Primary Examiner*—Ronald W. Biegel
*Attorney, Agent, or Firm*—Pravel, Hewitt, Kimball & Krieger

[57] ABSTRACT

A combination drill motor with measurement-while-drilling sensor apparatus includes a rotor within a stator. The rotor rotates and gyrates in response to fluid flow through the stator. An outer housing assembly having a bearing housing and a sensor housing is connected to the stator. A drive shaft is concentrically located within the bearing housing. A bearing assembly is positioned between the bearing housing and the drive shaft. A sensor cartridge assembly having a longitudinal throughbore is suspended within the sensor housing. A power transmission assembly connects the rotor to the drive shaft. The power transmission assembly includes a shaft assembly extending through the longitudinal throughbore in the sensor cartridge assembly. An annular space is formed in the longitudinal throughbore between the sensor cartridge assembly and the shaft assembly and the fluid flows through the annular space.

26 Claims, 5 Drawing Sheets

COMBINATION DRILL MOTOR WITH MEASUREMENT-WHILE-DRILLING ELECTRONIC SENSOR ASSEMBLY

BACKGROUND OF THE INVENTION

1. Field of the Invention

The present invention relates generally to a drill motor for driving a drill bit, and more particularly relates to the combination of a drill motor with a measurement-while-drilling sensor assembly.

2. Description of the Related Art

In recent years drilling operators have increasingly used downhole drilling devices of the positive displacement type to drill highly deviated wells. Positive displacement motors have been used worldwide as both a directional and a straight hole drilling tool. Positive displacement motors are derived from the Moineau pump. The downhole drilling device or "drill motor" rotates the drill bit and is powered by drilling mud pressurized by surface pumps transmitted to the drill motor through the drill string bore. In this mode of drilling, the entire drill string need not be continually rotated during drilling. This provides significant known advantages over rotary drilling, particularly when drilling highly deviated bore holes.

The "typical" drill motor will now be described. The drill motor has an elastomer stator with two or more lobes, and a chromium-plated steel rotor. The rotor has one lobe less than the stator, thus forming a series of progressive fluid cavities as the rotor turns within the stator. A dump valve, situated above the stator and rotor, is designed to allow the drilling fluid to bypass the motor and fill the drill pipe while going into the hole and to drain when pulling the string or making a connection.

When circulation of drilling fluid begins, drilling fluid forces a dump valve piston down, thereby closing the ports and directing the drilling fluid through the stator. Because of the eccentricity of the rotor in the stator, the circulated drilling fluid imparts a torque to the rotor, causing the rotor to turn and to pass the drilling fluid from chamber to chamber. The rotation of the rotor is transmitted to the drill bit via an articulated joint and rotating sub to which the drill bit is connected. Thrust and radial bearings are employed to withstand the axial and normal loads on the drill bit and rotating sub. An upper thrust bearing protects against hydraulic loads when the drill bit is off bottom and when there is circulation.

A bent sub or bent housing can be used above the drill motor to achieve the angular displacement between the axis of rotation of the drill bit and the axis of the drill string. The bent housing provides a bend to effect curved, non-linear drilling. Alternatively, the angular displacement can be obtained using a bent housing within the drill motor or by positioning a non-concentric stabilizer about the drill motor housing.

During drilling, a relatively straight bore hole can be drilled by simultaneously rotating the drill string and actuating the downhole drill motor. A curved section of bore hole can be drilled by activating the downhole drill motor while the drill string is not rotated. This technique is well known in the art and is disclosed in U.S. Pat. No. 4,492,276.

It is very important in drilling a bore hole to be able to make downhole measurements while the bore hole is being drilled. Measurement-while-drilling (MWD) and/or logging-while-drilling (LWD) systems are generally known to those of ordinary skill within the drilling industry. MWD and LWD systems measure various useful parameters and characteristics such as the inclination and azimuth of the bore hole, formation resistivity, and the natural gamma ray emissions from the formations. Examples of such devices are described in U.S. Pat. No. 5,456,106. Typically, signals are relayed to the surface with a mud pulse telemetry device that controls a valve which interrupts the mud flow and creates encoded pressure pulses inside the drill string. The pulses travel upward through the mud to the surface where they are detected and decoded so that the downhole measurements are available for observation and interpretation at the surface substantially in real time. Such systems are well known to those of skill in the art.

Typically, when an MWD system is used in combination with a drill motor, the MWD system tool is located a substantial distance above the drill motor and drill bit. Very commonly, the MWD system tool may be positioned as much as 20 to 40 feet above the bit, which necessarily means that the tool's measurements are made a substantial distance from the hole bottom. In directional drilling, it is desired to maintain the well bore within the pay zone for as long as possible since the desired fluids may be laterally displaced throughout the stratum. Therefore, a higher recovery of the production fluid occurs when drilling laterally through the stratum. The drill bit is typically steered through the pay zone by alternately rotating and sliding the drill string assembly and bit into a different direction. Due to the varying thicknesses of pay zone, it is extremely important to be able to accurately measure the location of the drill bit at all times. Thus, it is highly desirable to have a combination drill motor with MWD sensor assembly incorporated therein to obtain measurements very near the drill bit.

U.S. Pat. No. 5,456,106 to Harvey et al. discloses a modular MWD sensor assembly which mates with a typical positive displacement mud motor. An MWD tool (e.g., a mud pulse telemetry) is located above and connected to the mud motor with a typical cross-over assembly. The modular MWD sensor assembly includes an upper drive shaft portion having a flexible shaft connected to the mud motor and a lower sensor portion. The lower end of the flexible shaft is connected to a hollowed shaft extending beyond the lower end of the upper drive shaft portion. The lower sensor portion has a central channel extending longitudinally therethrough with the lower portion of the hollowed shaft extending through this channel. The sensor portion may comprise any type of MWD sensor, preferably sensors that benefit from obtaining measurements close to the bit. The lower end of the hollowed shaft is supported with a radial bearing and connected to an adjustable kick off assembly connected to the sensor portion. The adjustable kick off assembly is connected to a typical bearing pack assembly which connects to a drive shaft, a bit box and the drill bit.

U.S. Pat. No. 5,467,832 discloses an MWD system including a sensor sub positioned at the lower end of a downhole motor assembly. The sub houses instrumentalities that measure various downhole parameters such as borehole inclination, the natural gamma ray emission of the formations, the electrical resistivity of the formations, and a number of mechanical drilling performance parameters. Sonic or electromagnetic telemetry signals representing these measurements are transmitted to an MWD tool located above the motor, and telemetered by the MWD tool to the surface substantially in real time.

It is also desirable to have a combination drill motor with MWD sensor assembly that has structural integrity. It is also desirable that the combination drill motor with MWD sensor assembly have structural integrity without increasing the outer diameter of the tool since smaller tool diameter allows a smaller hole to be drilled. It is also desirable to have a combination drill motor with MWD sensor assembly that is dependable and reliable and preferably where the MWD sensors are protected against excessive vibration.

BRIEF SUMMARY OF THE INVENTION

The present invention is a combination drill motor with MWD sensor assembly that has structural integrity without increasing the outer diameter of the tool. The combination drill motor with MWD sensor assembly is dependable and reliable. The MWD sensors are protected against excessive vibration.

The combination drill motor with MWD sensor assembly includes a rotor within a stator. The rotor rotates and gyrates in response to fluid flow through the stator. An outer housing assembly having a bearing housing and a sensor housing is connected to the stator. A drive shaft is disposed within the bearing housing. A bearing assembly is positioned between the bearing housing and the drive shaft. A sensor cartridge assembly having a longitudinal throughbore is suspended within the sensor housing. A power transmission assembly connects the rotor to the drive shaft. The power transmission assembly includes a shaft assembly extending through the longitudinal throughbore in the sensor cartridge assembly. An annular space is formed in the longitudinal throughbore between the sensor cartridge assembly and the shaft assembly and the fluid flows through the annular space.

BRIEF DESCRIPTION OF THE VIEWS OF THE DRAWINGS

In order to more fully understand the drawings referred to in the detailed description of the present invention, a brief description of each drawing is presented, in which.

DETAILED DESCRIPTION OF THE INVENTION

Figure 1A:
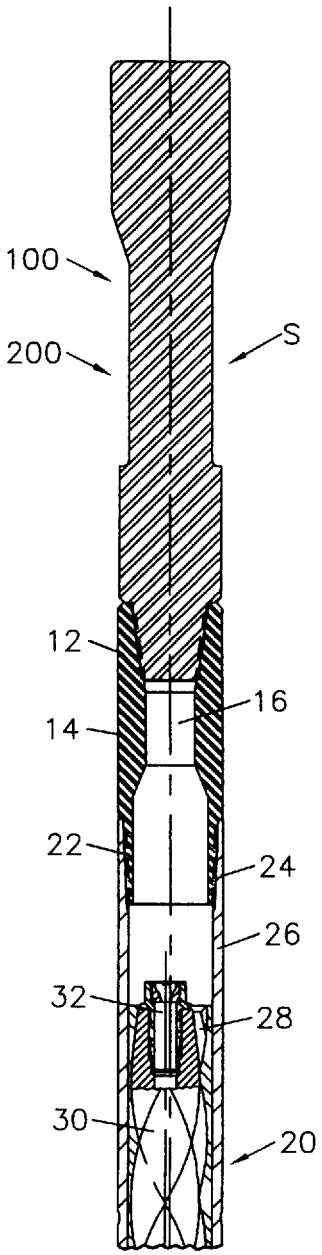
FIGS. 1A–1D are detailed fragmentary vertical sectional views of a first embodiment of the combination drill motor with measurement-while-drilling sensor assembly of the present invention from the upper portion to the lower portion thereof.

Referring to the drawings in greater detail, the combination drill motor with measure-while-drilling (MWD) sensor assembly according to the present invention is generally referred to as 100. The first embodiment of the combination drill motor with MWD sensor assembly 100 is shown in fragmentary vertical sectional views from the upper portion to the lower portion in FIGS. 1A–1D, respectively. A second embodiment of the combination drill motor with MWD sensor assembly, referred to as 200, is shown in fragmentary vertical sectional views from the upper portion to the lower portion in FIGS. 1A, 1B, 2 and 1D, respectively. It is to be understood that the portion shown in FIG. 1C is replaced by FIG. 2 in the second embodiment.

Referring to FIG. 1A, a lift sub S is shown attached to the upper end of the combination assembly 100. The lift sub S is a handling tool used to pick up the combination drill motor with MWD sensor assembly 100. The lift sub S is not a part of the combination drill motor with MWD sensor assembly 100. The lower end of the lift sub S includes a male threaded pin adapted to threadedly engage a female threaded box 12 in a top sub 14 of the combination assembly 100. The female threaded box 12 also provides the threaded connection with the upper drill string when in use. The top sub 14 includes a longitudinal passageway 16 therethrough. Alternatively, the top sub 14 could be a trip sub (not shown) having a valve (not shown), typically referred to as a dump valve, positioned within the passageway 16. The dump valve serves to turn the drill motor assembly 100 on and off. When the drilling fluid is being pumped the dump valve closes and directs drilling fluid through the drill motor assembly 100. When the drilling fluid is not being pumped the dump valve opens and allows the drilling fluid to exit through side ports (not shown) in the trip sub. The dump valve is designed to allow the drilling fluid to bypass the drill motor assembly 100 and fill the drill pipe while going into the hole and to drain when pulling the drill string or making a connection. The dump valve is a common feature in a drill motor assembly and is well known to those of ordinary skill in the art.

Figure 1B:
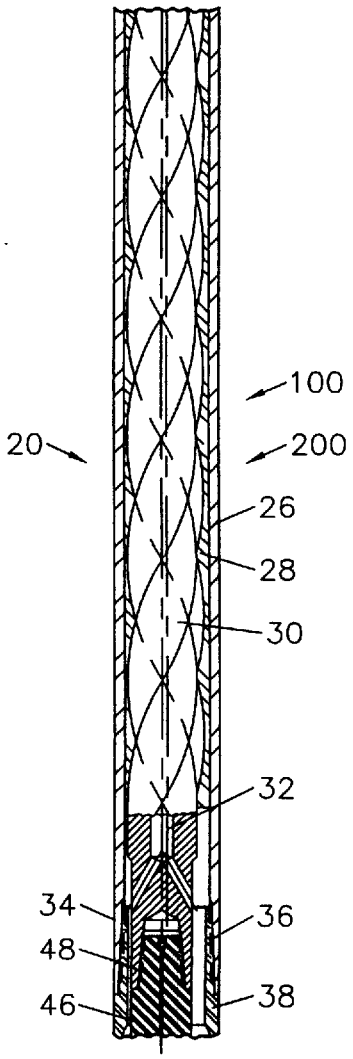
Figure 1C:
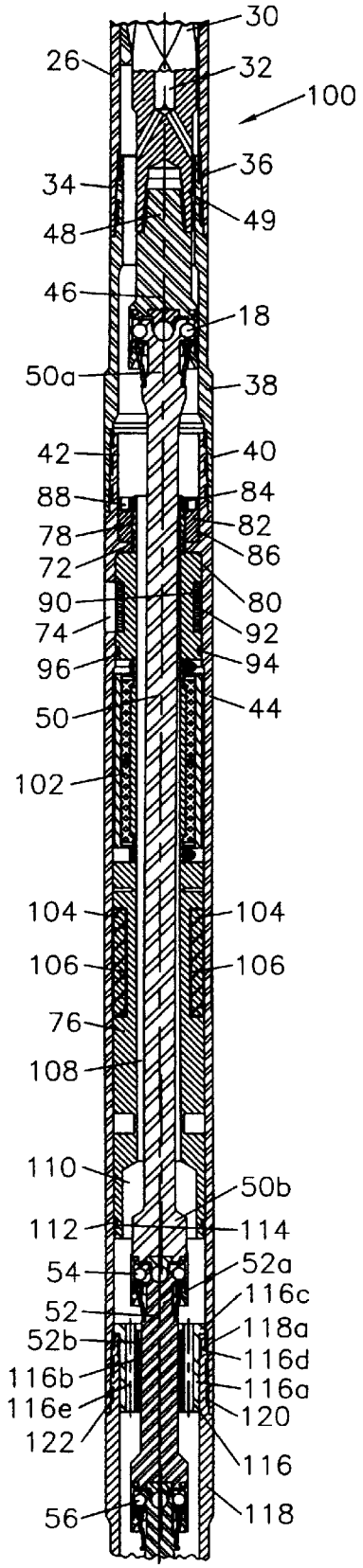

Referring to FIGS. 1A and 1B, the top sub 14 is connected to a prime mover 20 of the combination assembly 100. The prime mover 20 generates the power for rotating the drill bit (not shown) coupled to the lower end of the combination assembly. The prime mover 20 shown in the drawings is a positive displacement motor derived from the Moineau pump. However, it is to be understood that it is also contemplated that the positive displacement motor prime mover can be replaced with a drilling turbine or vein-type prime mover. Drilling turbines and vein type prime movers are commonly used as downhole mud motors and are well known to those of ordinary skill in the art.

Referring to FIG. 1A, the top sub 14 has a lower threaded pin 22 which is threaded into an upper threaded box 24 in a stator housing 26 of the prime mover 20. The stator housing 26 includes an elastomer rubber or rubber-like stator 28 having steeply pitched helical lobes which coact with an elongate rotor 30 having steeply pitched helical lobes. The stator 28 has one more lobe than the rotor 30, thus forming a series of progressive fluid cavities as the rotor 30 turns within the stator 28. Preferably, the rotor 30 includes a longitudinal bore 32 extending therethrough to allow additional flow of drilling fluid through the rotor 30/stator 28 assembly. Details of the stator and rotor lobes and their coaction are unnecessary to an understanding of the present invention. Such details are well known to those of ordinary skill in the art of drill motor design.

Referring to FIG. 1C, the lower end of the stator housing 26 includes a threaded box 34 which receives a threaded pin 36 of a stator crossover sub 38. As shown in FIG. 1C, the stator crossover sub 38 includes a lower threaded box 40 which engages with a threaded pin 42 of a sensor housing 44. The stator crossover sub 38 is preferably made from beryllium copper which provides flexibility with high strength. The flexibility of the stator crossover sub 38 helps to reduce the bending stresses in the area of the electronic sensors. The sensor housing 44 is preferably made from non-magnetic stainless steel.

Referring to FIG. 1C, a rotor socket 46 having a threaded pin 48 is attached to a threaded box 49 at the lower end of the rotor 30. As shown in FIG. 1C, the longitudinal bore 32 of the rotor 30 forks at the lower end of the rotor 30 to discharge drilling fluid in the annulus between the rotor 30 and the stator housing 26.

Referring to FIG. 1C, the lower end of the rotor socket 46 is connected to a sensor sub tie rod assembly 50 with an articulated joint or flex joint 18 of any suitable type. Articulated or flex joints 18 are commonly used in drill motors due to the orbital and rotational motion of the rotor 30. Such joints are well known to those of ordinary skill in the art of drill motor design. The lower end of the sensor sub tie rod assembly 50 is connected to a stub axle subassembly 52 with a flex joint 54.

Figure 1D:
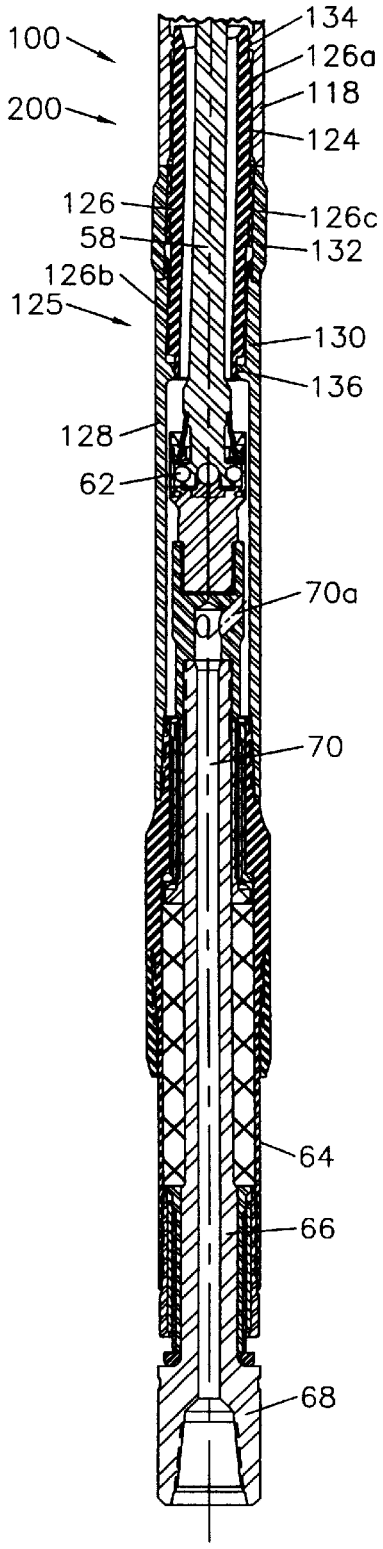

Referring to FIGS. 1C and 1D, the lower end of the stub axle subassembly 52 is connected with a flex joint 56 to a tie rod 58. The lower end of the tie rod 58 is connected to a bottom socket 60 with a flex joint 62 as shown in FIG. 1D. Referring to FIG. 1D, the bottom socket 60 is securely connected to a bearing pack subassembly 64. The bearing pack subassembly 64 includes a rotating drive shaft 66 having a lowermost threaded box 68 for connecting with the pin of a drill bit (not shown). The bearing pack subassembly 64, commonly used in drill motors, includes thrust and radial bearings to withstand the axial and normal loads on the drill bit and rotating drive shaft 66. An upper thrust bearing protects against hydraulic loads when the drill bit is off bottom and when there is circulation. One such bearing pack subassembly 64 is disclosed in commonly assigned U.S. Pat. application Ser. No. 08/638,379 for "Downhole Tool Bearing Assembly." Applicant incorporates by reference herein U.S. Pat. application Ser. No. 08/638,379. The rotating drive shaft 66 includes a longitudinal passageway 70 having a plurality of upper radial ports 70*a*. The upper radial ports 70*a* and the longitudinal passageway 70 provide a flow path for the drilling fluid through the rotating drive shaft 66. The drilling fluid exits the lower end of the rotating drive shaft 66 and enters and passes through the drill bit (not shown) connected to the lowermost threaded box 68.

The incorporation of the MWD sensors into the combination drill motor with MWD sensor assembly 100 will now be discussed in detail with reference to FIG. 1C. The sensor housing 44 includes a peripheral internal flange 72 near the upper end of the sensor housing 44. A plurality of apertures or longitudinal slots 74 extend through the wall of the sensor housing 44 for reasons which will be explained below. A sensor cartridge assembly 76 is slidably received within the sensor housing 44 from the lower end of the sensor housing 44. The sensor cartridge assembly 76 has an externally threaded upper end portion 78 of reduced diameter and an upper shoulder 80. Although not shown, preferably the peripheral internal flange 72 includes a plurality of alignment holes therethrough and the upper shoulder 80 of the sensor cartridge assembly 76 includes a like number and spacing of holes. Alignment pins (not shown) are inserted in the holes of the upper shoulder 80. The threaded upper end portion 78 extends through the peripheral flange 72 of the sensor housing 44 and the upper shoulder 80 abuts the lower face of the peripheral flange 72 with the alignment pins received within the alignment holes of the internal flange. It is to be understood that preferably the alignment pins and holes allow the sensor cartridge assembly 76 to be received and oriented in a single orientation with respect to the sensor housing 44. An internally threaded sensor cartridge nut 82 is inserted in the upper pin 42 of the sensor housing 44 and threadedly connected to the upper end portion 78 of the sensor cartridge assembly 76. An internal seal 84, preferably an O-ring seal, is provided between the sensor cartridge nut 82 and the upper end portion 78 of the sensor cartridge assembly 76. An external seal 86, preferably an O-ring seal, is provided between the sensor cartridge nut 82 and the sensor housing 44. The sensor cartridge nut 82 includes a plurality of blind bores 88 to facilitate the installation and removal of the sensor cartridge nut 82. The upper shoulder 80 of the sensor cartridge assembly 76 is securely drawn up to the peripheral flange 72 with the sensor cartridge nut 82.

Referring to FIG. 1C, the plurality of apertures or elongated slots 74 in the sensor housing 44 are aligned with an outer peripheral recess 90 formed in the sensor cartridge assembly 76. An antenna 92 is formed by placing several circumferential wraps of wire around the sensor cartridge assembly 76 in the outer peripheral recess 90. The antenna 92 extends circumferentially around the sensor cartridge assembly 76 but is mounted within the sensor housing 44. The presence of the plurality of apertures 74 in the sensor housing 44, adjacent to the antenna 92, permits electromagnetic signals to pass through the sensor housing 44 either to or from the antenna 92. This design also provides protection to the antenna 92 during drilling operations. These and other details and advantages of the internal antenna design are disclosed in commonly assigned U.S. Pat. application Ser. No. 08/759,729, which Applicant incorporates by reference. One or more seals 94 received in annular grooves 96 are provided to form a seal between the sensor cartridge assembly 76 and the sensor housing 44 at a location below the antenna 92.

Still referring to FIG. 1C, the sensor cartridge assembly 76 includes an exterior circumferential recess 98 for receiving a plurality of batteries 102 to power the sensors 104. The sensors 104 and the associated circuit boards and the like are housed in a plurality of pockets 106 formed in the outer periphery of the sensor cartridge assembly 76. Preferably, the sensor cartridge assembly 76 includes pockets 106 for sensors 104 and associated circuit boards to detect gamma rays, resistivity data, inclination, azimuth and speed. It is to be understood that other types of sensors 104 can also be incorporated into the present design in this manner.

The sensor cartridge assembly 76 includes a longitudinal throughbore 108 through which the sensor sub tie rod assembly 50 extends. Referring to FIG. 1C, the upper end 50*a* of the sensor sub tie rod assembly 50 is smaller in outside diameter than the diameter of the longitudinal throughbore 108 of the sensor cartridge assembly 76 to allow the upper end 50*a* to be inserted through the longitudinal throughbore 108. The lower end 50*b* of the sensor sub tie rod assembly 50 is received within the enlarged inner recess 110 of the sensor cartridge assembly 76. A plurality of seals 112 received in peripheral recesses 114 in the sensor cartridge assembly 76 seal the lower end of the sensor cartridge assembly 76 with the sensor housing 44.

Still referring to FIG. 1C, the stub axle subassembly 52 includes a stub axle 52*a* and a male centralizing bearing 52*b*. The male centralizing bearing 52*b* is a sleeve, preferably made of a wear resistant material, fitted onto the stub axle 52*a*. A female centralizing bearing 116 includes a sleeve 116*a* having a central bore 116*b*, an upper flange 116*c*, and external threaded portion 116*d* and a plurality of longitudinal bores 116*e* spaced about the periphery of the sleeve

116*a*. An adapter housing 118 having an upper threaded pin 120 is threadedly connected to a lower threaded box 122 of the sensor housing 44. The adapter housing 118 includes an upper internal threaded portion 118*a* which threadedly connects with the external threaded portion 116*d* of the female centralizing bearing 116. The lower surface of the upper flange 116*c* abuts the end of the upper threaded pin 120 of the adapter housing 118. The female centralizing bearing 116 slides over the upper end of the stub axle 52*a* and onto the male centralizing bearing 52*b*. The plurality of longitudinal bores 116*e* provide a path for the drilling fluid.

It is to be understood that in this first embodiment of the combination drill motor with MWD sensor assembly 100, the sensor sub tie rod assembly 50 has orbital and rotational motion at its upper end 50*a* but substantially only rotational motion at the lower end 50*b* after passing through the sensor cartridge assembly 76. Thus, the longitudinal throughbore 108 in the sensor cartridge assembly 76 is large enough to avoid contact with the sensor sub tie rod assembly 50 as it rotates and orbits. Furthermore, the drilling fluid flows through an annular space 108*a* in the longitudinal throughbore 108 between the cartridge assembly 76 and the sensor sub tie rod assembly 50. The motion of the stub axle subassembly 52 is only rotational motion.

Referring to FIG. 1D, preferably an adjustable bent housing, generally referred to as 125, is incorporated into the combination drill motor with MWD sensor assembly 100. As previously discussed, adjustable bent housings 125 are well known in the art. To incorporate the adjustable bent housing 125, the lower end of the adapter housing 118 has an internally threaded portion 124 which is threadedly connected to a splined mandrel 126. The splined mandrel 126 has externally threaded upper and lower portions 126*a* and 126*b*, respectively. The splined mandrel 126 has an externally splined mid-portion 126*c*. The externally threaded upper portion 126*a* is threadedly connected to the threaded portion 124 of the adapter housing 118. The externally threaded lower portion 126*b* is threadedly connected to an internally threaded portion 130 of an offset housing 128. An internally splined adjusting ring 132 is mounted over the externally splined mid-portion 126*c* of the splined mandrel 126. A seal 134 is positioned between the adapter housing 118 and the splined mandrel 126. A seal 136 is positioned between the offset housing 128 and the splined mandrel 126. Additional details about the adjustable bent housing 125 are unnecessary as they are well known in the art.

It is to be understood that the flex joints 56 and 62 at the ends of the tie rod 58 extending through the adjustable bent housing 125 are required as a result of the adjustable bent housing 125. Thus, although the tie rod 58 only rotates, it will not rotate along the longitudinal axis of the drill motor 100 when the drill motor 100 is "bent" due to the adjustable bent housing 125. It is also to be understood that the drill motor with MWD sensor assembly 100 according to the first embodiment could also be assembled without the adjustable bent housing 125. In this instance, a single tie rod 58 could be threadedly connected between the sensor sub tie rod assembly 50 and the rotating drive shaft 66.

Preferably, a clearance of approximately 0.010 inch exists between the sensor cartridge assembly 76 and the sensor housing 44. This enables the sensor housing 44 to bend slightly prior to imparting bending forces to the sensor cartridge assembly 76.

It is also to be understood that the sensor housing 44 is a structural member and the internal sensor cartridge assembly 76 is not a structural member but its primary function is to house the MWD sensors.

The second embodiment of the combination drill motor with MWD sensor assembly 200 will now be discussed in detail with reference to FIGS. 2–4. As mentioned above the differences between the second embodiment 200 and the first embodiment 100 are shown by comparing FIG. 2 with FIG. 1C. The differences between the two embodiments is primarily in the power transmission from the rotor 30 to the drive shaft 66 as will be further explained below.

Figure 2:
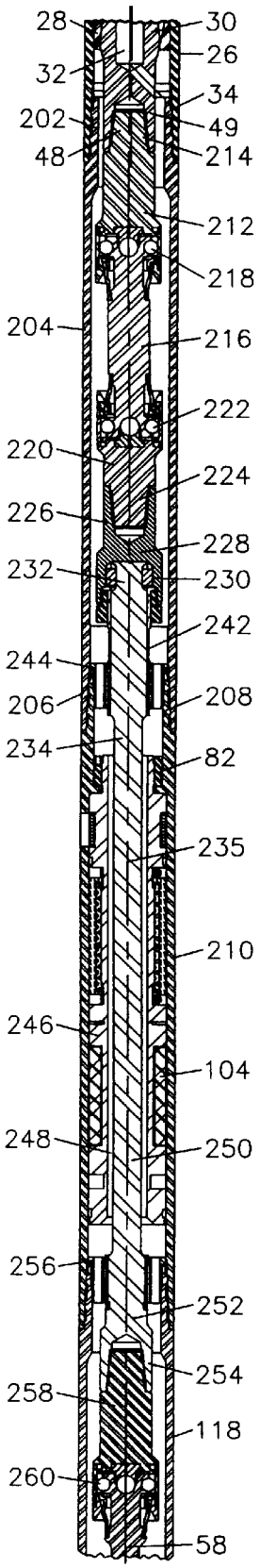
FIG. 2 is a detailed fragmentary vertical sectional view of a portion of a second embodiment of the combination drill motor with measurement-while-drilling sensor assembly which replaces the portion shown in FIG. 1C of the first embodiment.

Referring to FIG. 2, the lower end of the stator housing 26 includes a threaded box 34 which receives a threaded pin 202 of a stator crossover sub 204. As shown in FIG. 2, the stator crossover sub 204 includes a lower threaded box 206 which engages a threaded pin 208 of a sensor housing 210.

Referring to FIG. 2, a rotor socket 212 having a threaded pin 214 is attached to the threaded box 48 at the lower end of the rotor 30. As shown in FIG. 2, the longitudinal bore 32 of the rotor 30 forks at the lower end of the rotor 30 to discharge drilling fluid in the annulus between the rotor 30 and the stator housing 26.

Still referring to FIG. 2, the lower end of the rotor socket 212 is connected to a flex joint subassembly 216 with an articulated joint or flex joint 218. The lower end of the flex joint subassembly 216 is connected to a hub socket 220 with a flex joint 222. Referring to FIGS. 2 and 3, the lower end of the hub socket 220 includes a threaded pin 224 which engages a threaded box 226 of a transmission hub 228. The transmission hub 228 includes a lower receptacle 230 for receiving an upper end 232 of the transmission shaft subassembly 234 as shown in FIGS. 3 and 4. The lower receptacle 230 of the transmission hub 228 includes a plurality of generally semi-cylindrical recesses 230*a*. The upper end 232 of the transmission shaft subassembly 234 includes a corresponding number of generally semi-cylindrical recesses 232*a* around the periphery of the upper end 232. A plurality of pins 231 are received within the corresponding pairs of recesses 230*a* and 232*a*. Preferably, the upper end 232 has a lip 232*b* which longitudinally maintains the pins 231 within the recesses 232*a*. It is to be understood that this removable spline connection with the pins 231 in the recesses 230*a* and 232*a* provides a very high torque transferring connection between the transmission shaft subassembly 234 and the transmission hub 228. It is also to be understood that this strong, removable spline connection is very small in cross section which is important from both a functional standpoint as well as an assembly standpoint which will be explained in greater detail below. It is to be further understood that the spline connection is not limited to the configuration shown but also includes variations in the size, number and shape of the various components making up the spline connection.

Figure 3:
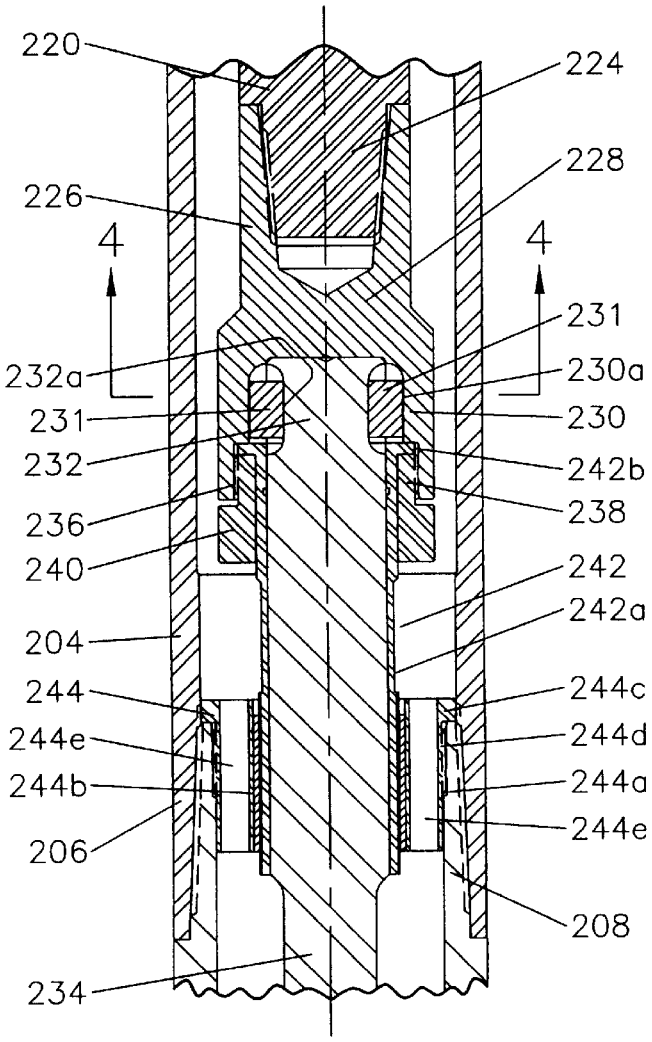
FIG. 3 is an enlarged fragmentary vertical sectional view of a portion of the second embodiment of the combination drill motor with measurement-while-drilling sensor assembly showing a removable spline connection between a transmission hub and a transmission shaft subassembly.
Figure 4:
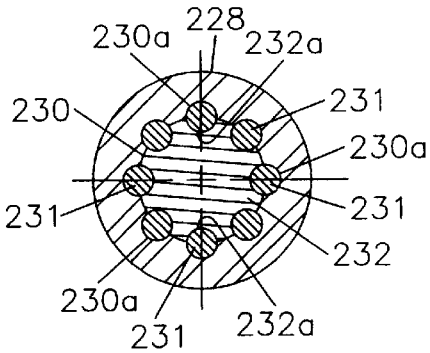
FIG. 4 is a view taken along line 4—4 of FIG. 3.

Referring to FIG. 3, the lower receptacle 230 of the transmission hub 228 also includes an internally threaded portion 236 which threadedly mates with an externally threaded portion 238 of a hub retainer 240. A male centralizing bearing 242 includes a sleeve 242*a* which is slidably received on the upper end 232 of the transmission shaft subassembly 234. The male centralizing bearing 242 includes a peripheral flange 242*b* at the upper end of the bearing 242. The male centralizing bearing 242 is secured in place on the upper end 232 by the hub retainer 240 as shown in FIG. 3.

Referring to FIG. 3, an upper female centralizing bearing 244 is similar in construction to the female centralizing bearing 116 included in the first embodiment of the present invention as described above. The upper female centralizing bearing 244 includes a sleeve 244*a* having a central bore 244*b*, an upper flange 244*c*, and external threaded portion 244*d* and a plurality of longitudinal bores 244*e* spaced about the periphery of the sleeve 244*a*. The external threaded portion 244*d* of the upper female centralizing bearing 244 is threadedly engaged with the upper end of the pin 208 of the sensor housing 210. The lower surface of the upper flange 244*c* abuts the end of the threaded pin 208 of the sensor housing 210. The upper female centralizing bearing 244 slides over the upper end 232 of the transmission shaft subassembly 234 and onto the male centralizing bearing 242. The plurality of longitudinal bores 244*e* provide a path for the drilling fluid to pass.

Referring to FIG. 2, a sensor cartridge assembly 246 in the second embodiment of the present invention 200 is substantially the same and performs the same functions as the sensor cartridge assembly 76 described above and is shown installed in the same manner with the sensor cartridge nut 82. As shown in FIG. 2, the enlarged inner recess 110 (FIG. 1C) of the sensor cartridge assembly 76 is not required in the sensor cartridge assembly 246 of the second embodiment 200. The sensor cartridge assembly 246 has a longitudinal throughbore 248. The diameter of the throughbore 248 is greater than the upper end 232 of the transmission shaft subassembly 234 to permit the transmission shaft subassembly 234 to be inserted through the longitudinal throughbore 238. Preferably, an annular space 250 is formed in the longitudinal throughbore 248 between the sensor cartridge assembly 246 and the transmission shaft subassembly 234. While not shown in the drawings, an alternative design in the second embodiment of the combination assembly 200 is to enlarge the diameter of the shaft portion 235 of the transmission shaft subassembly 234, thereby reducing the annular space 250, and to provide a longitudinal passageway through the shaft portion 235 with fluid inlet and outlet ports at the ends of the transmission shaft subassembly 234.

The transmission shaft subassembly 234 includes an enlarged lower end 252 having a threaded box 254. A lower female centralizing bearing 256 circumscribes the enlarged lower end 252 of the transmission shaft subassembly 234. The lower female centralizing bearing 256 is similar in construction to the upper female centralizing bearing 244. The lower female centralizing bearing 256 is threadedly mated to a pin 120 of the adapter housing 118.

A socket 258 is threadedly connected to the threaded box 254 of the transmission shaft subassembly 234. The lower end of the socket 258 is connected with a flex joint 260 to a tie rod 58.

It is to be understood that in the second embodiment of the combination drill motor with MWD sensor assembly 200, the flex joint subassembly 216 has orbital and rotational motion at its upper end but substantially only rotational motion at its lower end. The transmission shaft subassembly 234 passing through the longitudinal throughbore 248 of the sensor cartridge assembly 246 and the upper and lower female centralizing bearings 244 and 256, respectively, has rotational motion without orbital motion. Thus, the longitudinal throughbore 248 in the sensor cartridge assembly 246 is large enough to avoid contact with the transmission shaft subassembly 234 as it rotates. Additionally, the longitudinal throughbore 248 is large enough to permit the upper end 232 of the transmission shaft subassembly 234 to pass through during assembly. Also, the drilling fluid flows through the annular space 250 in the longitudinal throughbore 248 between the sensor cartridge assembly 246 and the transmission shaft subassembly 234. The motion of the socket 258 is only rotational motion.

Preferably, the combination drill motor with MWD sensor assembly 200 includes an adjustable bent housing 125 as shown in FIG. 1D and as described above. It is also to be understood that the combination drill motor with MWD sensor assembly 200 can also be made without the adjustable bent housing 125, if desired.

It is to be understood from the above that the combination drill motor with MWD sensor assembly 200 allows a smaller diameter longitudinal throughbore 248 than the longitudinal throughbore 108 in the combination drill motor with MWD sensor assembly 100. This is due to the fact that the shaft 234 extending through the throughbore 248 rotates only whereas the shaft 50 extending through the throughbore 108 both rotates and orbits.

The combination drill motor with MWD sensor assembly 200 can be manufactured in smaller diameters than the combination drill motor with MWD sensor assembly 100 since the sensor cartridge assembly 246 can be made slightly smaller in diameter due to the pure rotation factor discussed above. The reduced diameter of the sensor cartridge assembly 246 additionally results in a reduction of the diameter of the sensor housing 210 which typically has the largest diameter of the drill motor components. The end result is a combination drill motor with MWD sensor assembly 200 having a diameter no greater than previous drill motors without sensors. Additionally, this has been accomplished without sacrificing structural integrity in the outer housing of the drill motor.

It is to be understood that the combination drill motor with MWD sensor assemblies 100 and 200 provide additional advantages over the prior art tools of this type. For example, the highly sensitive electronic sensors are mounted in a sensor cartridge assembly 76, 246 which is primarily a jacket for the sensors and not a structural or load transferring member. As discussed above, the sensor housing 44, 210 is the structural member and will bend or deflect slightly without affecting the sensor cartridge assembly 76, 246.

Figure 5:
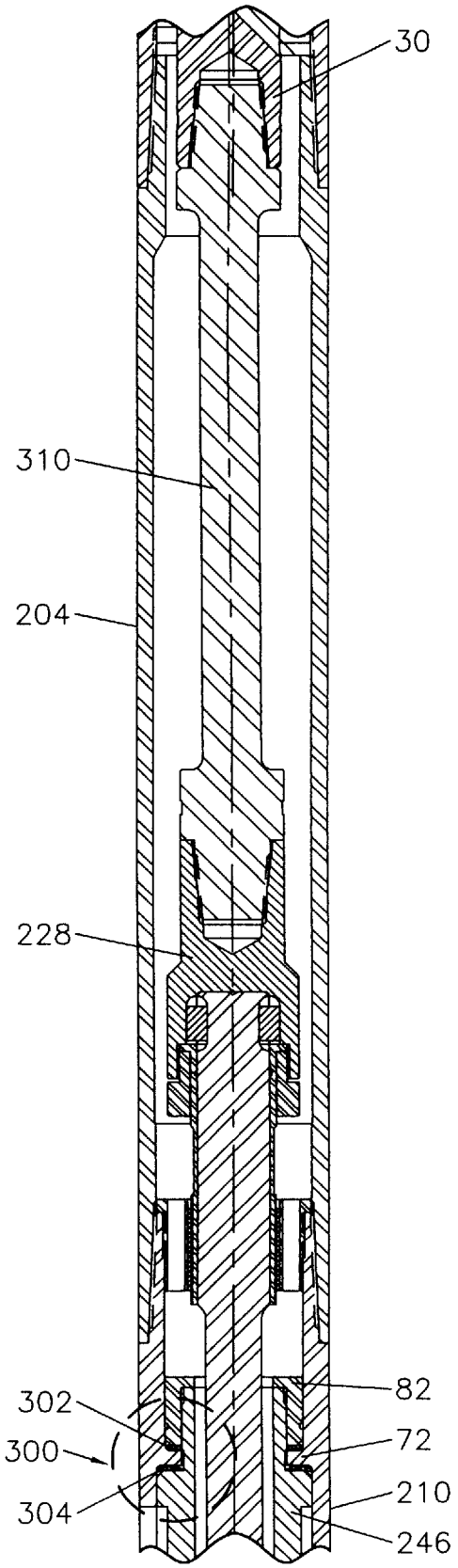
FIG. 5 is a detailed fragmentary vertical sectional view of a portion of another embodiment of the combination drill motor with measurement-while-drilling sensor assembly showing a flexible shaft and a suspension assembly for the sensor cartridge.
Figure 6:
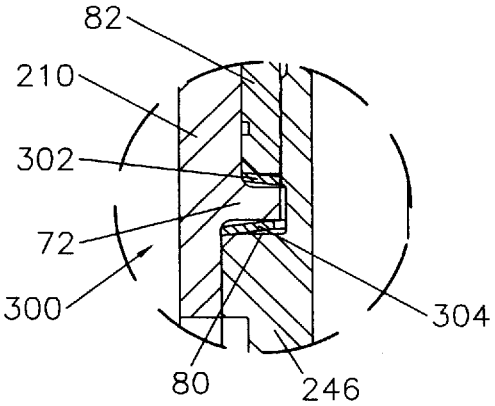
FIG. 6 is an enlarged view of the encircled portion of FIG. 5 showing the suspension assembly.

It may be further desirable to incorporate a suspension assembly in the mounting of the sensor cartridge assembly 76, 246 to minimize vibration of the sensitive electronic sensors. Referring to FIGS. 5 and 6, one type of suspension assembly 300 for the sensor cartridge assembly 246 is shown. It is to be understood that this suspension assembly 300 could also be used with the sensor cartridge assembly 76 shown in FIG. 1C. A pair of disc springs 302 and 304 are positioned between the sensor cartridge nut 82 and the upper shoulder 80 of the sensor cartridge assembly 246 on either side of the peripheral flange 72. It is to be understood that the disc springs 302 and 304 could be replaced with other resilient items to provide a cushion or dampen any vibration experienced by the outer housing of the drill motor assembly 100, 200.

It is also to be understood that the advantages and benefits of the present invention are not limited to the specific designs shown and described in FIGS. 1–4 but are also applicable to variations of these designs. For example, one variation is to use a flexible shaft in an area which is required to both rotate and orbit. It is well known in the art that a flexible shaft may be used to rotate and orbit. Referring to FIG. 5, the flexible shaft 310, preferably made from a high strength to stiffness ratio material as for example titanium, is threadedly connected between the rotor 30 and the transmission hub 228. It is to be understood that the flexible shaft 310 in FIG. 5 replaces the rotor socket 212, flex joint subassembly 216, flex joint 218, hub socket 220 and flex joint 222 in FIG. 2.

The foregoing disclosure and description of the invention is illustrative and explanatory thereof, and various changes in the size, shape, and materials, as well as in the details of illustrative construction and assembly, may be made without departing from the spirit of the invention.

What is claimed is:

1. A combination drill motor with measurement-while-drilling sensor apparatus comprising:

a stator;

a rotor within said stator, said rotor rotating and gyrating in response to fluid flow through said stator;

an outer housing assembly connected to said stator, said outer housing assembly having a bearing housing and a sensor housing;

a drive shaft disposed within said bearing housing;

a bearing assembly between said bearing housing and said drive shaft;

an electronics cartridge assembly within said sensor housing, said electronics cartridge assembly having a longitudinal throughbore;

a power transmission assembly connecting said rotor to said drive shaft, said power transmission assembly including a shaft assembly extending through said longitudinal throughbore in said electronics cartridge assembly, wherein an annular space is formed in said longitudinal throughbore between said electronics cartridge assembly and said shaft assembly and the fluid flows through said annular space.

2. The apparatus of claim 1, wherein said electronics cartridge assembly comprises:

a cartridge having an outer periphery and said longitudinal throughbore; and electronic sensors housed around said outer periphery of said cartridge.

3. The apparatus of claim 1, further comprising a means for suspending said electronics cartridge assembly within said sensor housing.

4. The apparatus of claim 3, wherein said means for suspending comprises:

said sensor housing having an internal flange; and said electronics cartridge assembly secured to said internal flange.

5. The apparatus of claim 4, wherein said means for suspending further comprises a resilient spring mounted between said internal flange and said electronics cartridge assembly.

6. The apparatus of claim 1, wherein said power transmission assembly further comprises an upper rod assembly connecting to said rotor and said shaft assembly.

7. The apparatus of claim 6, wherein said upper rod assembly includes an articulated joint.

8. The apparatus of claim 6, wherein said upper rod assembly includes a flexible shaft.

9. The apparatus of claim 6, wherein said shaft assembly rotates concentrically within said longitudinal throughbore.

10. The apparatus of claim 1, wherein said shaft assembly rotates and orbits within said longitudinal throughbore.

11. The apparatus of claim 1, further comprising an adjustable bent housing assembly mounted above said bearing housing.

12. The apparatus of claim 10, wherein said shaft assembly includes a spline joint for connecting to said upper rod assembly.

13. In a combination mud motor with measurement-while-drilling sensor apparatus having a prime mover responsive to fluid flow therethrough, an outer housing coupled to the prime mover, and a bearing housing receiving a bearing assembly and a drive shaft, the improvement comprising:

an electronics cartridge assembly mounted internally within the outer housing, said electronics cartridge assembly having a longitudinal throughbore;

a power transmission assembly connecting the prime mover to the drive shaft, said power transmission assembly including a shaft extending through said longitudinal throughbore in said electronics cartridge assembly, wherein the fluid flows through said longitudinal throughbore.

14. The apparatus of claim 13, wherein said electronics cartridge assembly comprises:

a cartridge having an outer periphery and said longitudinal throughbore, said longitudinal throughbore concentrically aligned in said cartridge; and electronic sensors housed around said outer periphery of said cartridge.

15. The apparatus of claim 13, further comprising a means for suspending said electronics cartridge assembly within the outer housing.

16. The apparatus of claim 15, wherein said means for suspending comprises:

an internal flange in the outer housing; and said cartridge secured to said internal flange.

17. The apparatus of claim 16, wherein said means for suspending further comprises a resilient spring mounted between said internal flange and said cartridge.

18. The apparatus of claim 13, wherein said power transmission assembly further comprises an upper rod assembly connecting the prime mover to said shaft.

19. The apparatus of claim 18, wherein said upper rod assembly includes an articulated joint.

20. The apparatus of claim 18, wherein said upper rod assembly includes a flexible shaft.

21. The apparatus of claim 13, wherein said shaft rotates and orbits within said longitudinal throughbore.

22. The apparatus of claim 18, wherein said shaft rotates concentrically within said longitudinal throughbore.

23. The apparatus of claim 22, wherein said shaft includes a spline joint for connecting to said upper rod assembly.

24. The apparatus of claim 13, further comprising an adjustable bent housing assembly mounted above the bearing housing.

25. The apparatus of claim 13, wherein an annular space is formed in said longitudinal throughbore between said electronics cartridge assembly and said shaft and the fluid flows through said annular space.

26. A downhole tool apparatus comprising:

an outer cylindrical housing;

a cylindrical cartridge within said outer cylindrical housing, said cylindrical cartridge having an outer periphery and a longitudinal throughbore;

means for suspending said cylindrical cartridge within said outer cylindrical housing, said means for suspending comprising:

an internal flange in said outer housing; and said cylindrical cartridge secured to said internal flange a resilient spring mounted between said internal flange and said cylindrical cartridge; and electronic sensors housed around said outer periphery of said cylindrical cartridge.

* * * * *